US010695807B2

(12) United States Patent
Lee

(10) Patent No.: US 10,695,807 B2
(45) Date of Patent: Jun. 30, 2020

(54) DEVICE FOR FORMING ROUND BAR INTO VARIABLE SHAPES

(71) Applicant: Hanyoung Machinery, Gimhae-si, Gyeongsangnam-do (KR)

(72) Inventor: Young Sik Lee, Busan (KR)

(73) Assignee: Hanyoung Machinery, Gimhae-si, Gyeongsangnam-do (KR)

( * ) Notice: Subject to any disclaimer, the term of this patent is extended or adjusted under 35 U.S.C. 154(b) by 169 days.

(21) Appl. No.: 15/750,156

(22) PCT Filed: Jan. 5, 2016

(86) PCT No.: PCT/KR2016/000070
§ 371 (c)(1),
(2) Date: Feb. 2, 2018

(87) PCT Pub. No.: WO2017/026602
PCT Pub. Date: Feb. 16, 2017

(65) Prior Publication Data

US 2018/0250725 A1 Sep. 6, 2018

(30) Foreign Application Priority Data

Aug. 13, 2015 (KR) ..... 10-2015-0114689
Sep. 30, 2015 (KR) ..... 10-2015-0137559

(51) Int. Cl.
*B21B 1/08* (2006.01)
*B21H 1/20* (2006.01)
(Continued)

(52) U.S. Cl.
CPC ..... *B21B 1/08* (2013.01); *B21B 1/16* (2013.01); *B21B 1/166* (2013.01); *B21D 7/08* (2013.01);
(Continued)

(58) Field of Classification Search
CPC .. B21D 7/08; B21D 3/02; B21B 13/08; B21B 13/10; B21B 13/103; B21B 1/00;
(Continued)

(56) References Cited

U.S. PATENT DOCUMENTS 4,255,956 A * 3/1981 Zacharias ..... B21B 1/026 72/225
4,275,578 A 6/1981 Steinbrecher et al.
5,230,352 A 7/1993 Putnam et al.

FOREIGN PATENT DOCUMENTS

DE 19630025 A1 * 1/1998 ..... B21D 7/08
GB 433390 A 8/1935
(Continued)

OTHER PUBLICATIONS

EPO machine translation of DE-19630025-A1 (Year: 2019).*
(Continued)

*Primary Examiner* — Pradeep C Battula
(74) *Attorney, Agent, or Firm* — Peter W. Schroen; Bret E. Field; Bozicevic, Field & Francis LLP

(57) ABSTRACT

The present invention relates to a device for forming a round bar into variable shapes, comprising: a main body provided with a plate portion with a circular shape having a plate hole formed in a center thereof, having plate protrusions protruding to the plate portion in a radial shape, and a turn gear connecting portion formed at an outer circumference surface of the plate portion; a round bar forming portion coupled between the plate protrusions and having a slide mold seated on the plate portion and a forming roll coupled to the slide mold to rotate; and a turn gear having a donut shape, provided with a turn gear protruding portion with a circular arc shape having different diameters from a center in an inner surface thereof, and disposed between the slide mold and the turn gear connecting portion.

7 Claims, 5 Drawing Sheets

(51) Int. Cl.

| | |
|---|---|
| ***B21B 1/16*** | (2006.01) |
| ***B21D 7/08*** | (2006.01) |
| *B21D 15/02* | (2006.01) |
| *B21B 31/22* | (2006.01) |

(52) U.S. Cl.
CPC ..... *B21H 1/20* (2013.01); *B21B 31/22* (2013.01); *B21D 15/02* (2013.01)

(58) Field of Classification Search
CPC .. B21B 1/02; B21B 1/026; B21B 1/08; B21B 1/16; B21B 1/166; B21H 1/18; B21H 1/20
See application file for complete search history.

(56) References Cited

FOREIGN PATENT DOCUMENTS

| | | | |
|---|---|---|---|
| JP | H910801 | A | 1/1997 |
| JP | H11277109 | A | 10/1999 |
| KR | 10-2012-0106199 | A | 9/2012 |

OTHER PUBLICATIONS

Extended European Search Report for European Application No. 1683524.4 dated Mar. 14, 2019, 8 pages.
Examination Report for Indian Application No. 201817003336 dated Oct. 31, 2019, 6 pages.
Notice of Reasons for Refusal for Japanese Application No. 2018-526472 dated Jan. 17, 2019, with its English translation, 7 pages.
Decision to Grant a Patent for Japanese Application No. 2018-526472 dated Aug. 9, 2019, with its English translation, 5 pages.
Notice of Reasons for Refusal for Korean Application No. 10-2015-0114689 dated Apr. 20, 2016, with its English translation, 5 pages.
Grant of Patent for Korean Application No. 10-2015-0114689 dated Oct. 17, 2016, with its English translation, 2 pages.
Grant of Patent for Korean Application No. 10-2015-0137559 dated Sep. 27, 2016, with its English translation, 2 pages.
The First Office Action for Chinese Application No. 201680047354.9 dated Oct. 19, 2018, with its English translation, 9 pages.
The Second Office Action for Chinese Application No. 201680047354.9 dated Jun. 19, 2019, with its English translation, 11 pages.
Notification to Grant Patent Right for Invention for Chinese Application No. 201680047354.9 dated Oct. 9, 2019, with its English translation, 4 pages.

* cited by examiner

[Fig. 1]
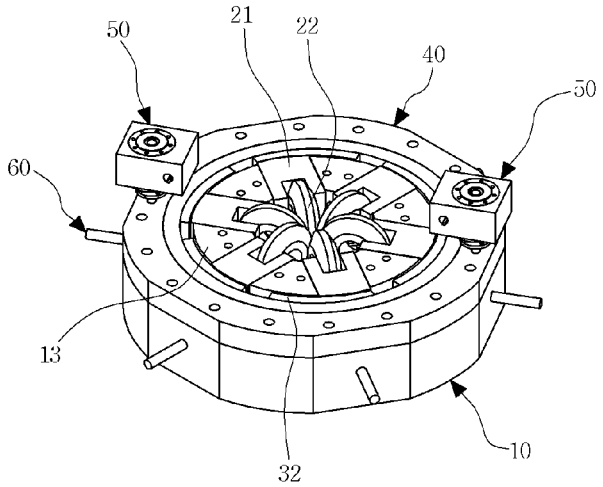
[Fig. 2]
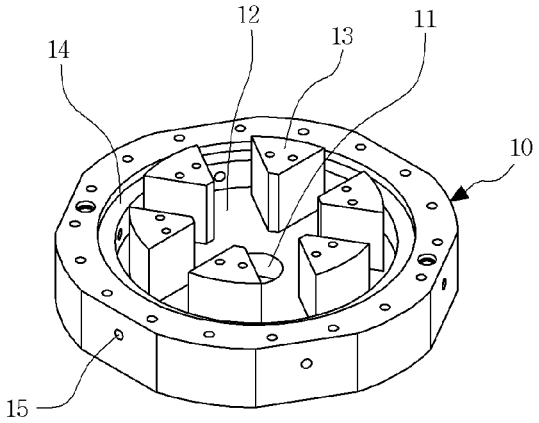

[Fig. 3]
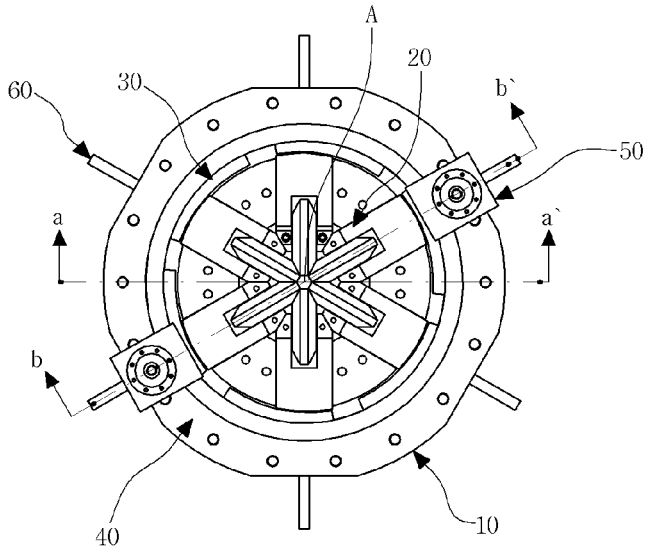

[Fig. 4]
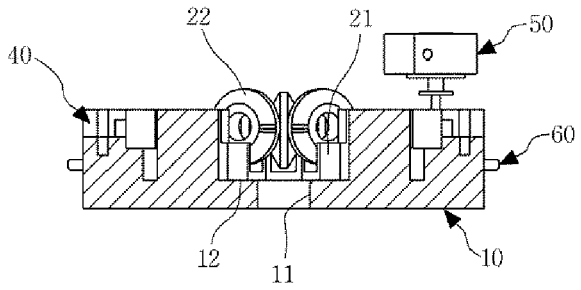
[Fig. 5]
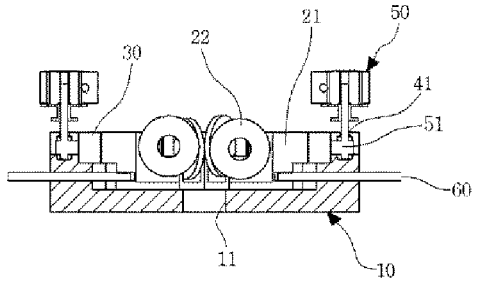
[Fig. 6]
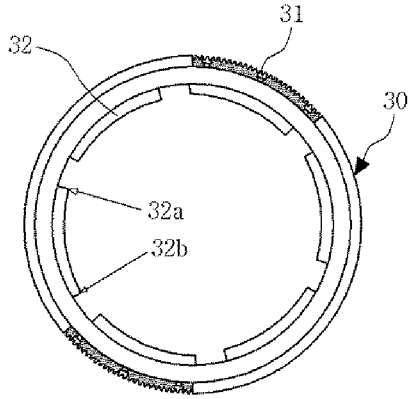

[Fig. 7]
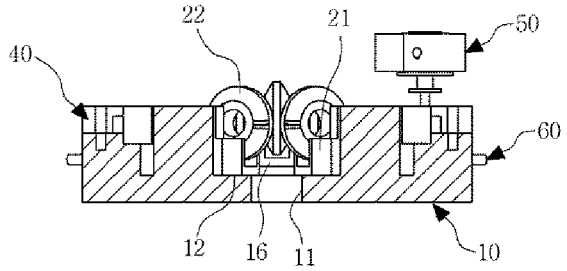
[Fig. 8]
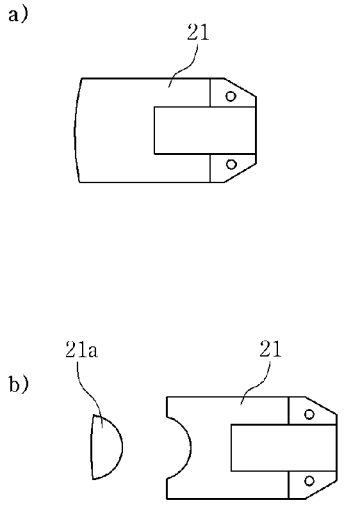
[Fig. 9]
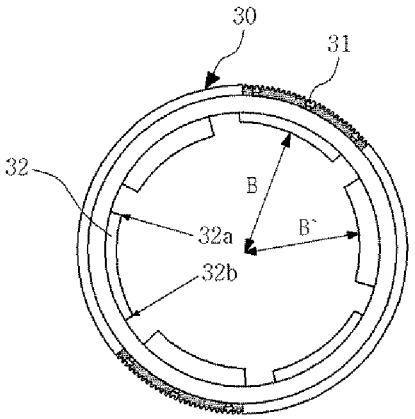

[Fig. 10]
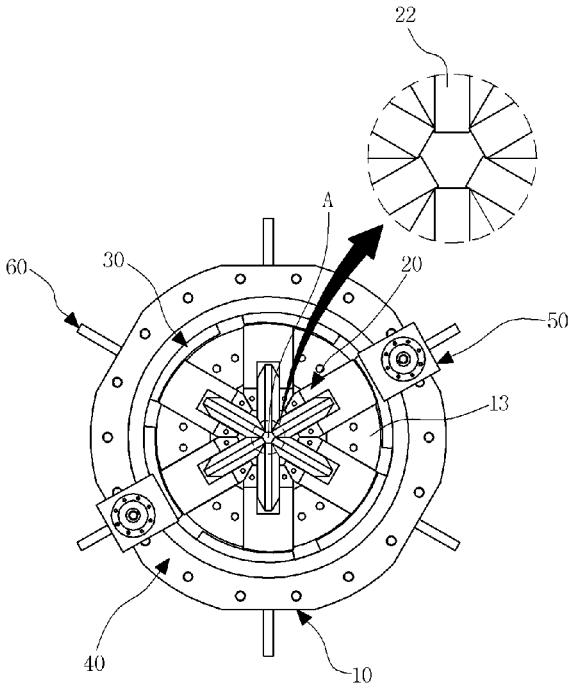

DEVICE FOR FORMING ROUND BAR INTO VARIABLE SHAPES

CROSS-REFERENCE TO RELATED APPLICATION

This Application is a Section 371 National Stage Application of International Application No. PCT/KR2016/000070, filed Jan. 5, 2016, the contents of which is hereby incorporated by reference in its entirety.

TECHNICAL FIELD

The present invention relates to a device for forming a round bar into variable shapes, and more particularly, to a device for forming a round bar into variable shapes, in which an interval of a forming portion where the round bar is formed can be adjusted.

BACKGROUND

In general, with respect to the device drawing a stainless round bar made of a soft material, it is important to fix forming rolls to prevent them from moving because of large force exerted to the forming rolls. In order to form round bars having a relatively large diameter into rectangular or hexagonal bars having a smaller diameter, a plurality of forming rolls are arranged in series to gradually reduce the diameter thereof during the drawing, which minimizes any forming defect which may caused by a burr in a corner occurring during the forming. Here, it is necessary to change a passage hole between forming rolls to form round bars with different diameters. Whenever it is necessary to form round bars with different diameters, the adjustment of an interval of the passage hole involves dissembling and reassembling of a mold frame and the forming rolls to adjust the passage hole, or replacing with a mold frame with a passage hole meeting a size requirement. Thus, a lot of time consumes to set the round bar forming device upon forming round bars of different sizes. Also, there may be a breakage of a bolt coupling the mold frame and forming rolls and a mold frame to which a plurality of forming rolls are coupled should be prepared to prevent the breakage.

In addition, in the case of forming a bar having a polygonal cross-section, there may be a problem of incomplete forming at the corner of the polygon because of a step occurring between a forming roll and an adjacent forming roll. To resolve this issue, Korea Patent No. 10-1254919 discloses a device for forming a round bar including a spaced bracket and roller, in which a feeding device is provided in a frame, a clamp is provided in the other frame, and a forming device is provided at the end portion of the other frame. Also, the device further includes four forming rolls having an inner rim, an outer rim producing direct friction with the round bar to process the round bar, rolling bodies deposed between the inner rim and the outer rim for the rotation of the outer rim, and a rolling body cover to fix the rolling bodies. The device also includes a bracket where two forming rolls are coupled and a second bracket where the other two forming rolls are coupled, while being spaced apart from the first bracket to prevent the incomplete forming occurring at an edge of the round bar. However, it is problematic in that when the round bar is first formed by a forming roll and then second formed by a forming roll that is spaced apart by a predetermined distance, the dimension of the surface formed during the first forming may be diminished due to force generated during the second forming, which substantially decreases the size accuracy.

DISCLOSURE

Technical Problem

Disclosed is a device for forming a round bar into variable shapes, through which a stainless round bar made of a soft material and inserted into one frame equipped with a feeding device is formed by a forming roll provided in a base frame while being pulled toward a clamp provided in another frame to form the round bar. In addition, upon forming round bars of different sizes, the passage hole between forming rolls can be effectively controlled so as to form polygonal bars with increased size accuracy.

TECHNICAL SOLUTION

Disclosed is a configuration to achieve the present invention. The device for forming a round bar into variable shapes in which a diameter of a passage hole A varies, the device including: a main body 10 provided with a plate portion 12 with a circular shape having a plate hole 11 formed in a center thereof, having six plate protrusions 13 protruding to the plate portion 12 in a radial shape, and a turn gear connecting portion 14 formed at an outer circumference surface of the plate portion 12; a round bar forming portion 20 coupled between the plate protrusions 13 and having six slide molds 21 seated on the plate portion 12 and forming rolls 22 coupled to the respective slide molds 21 to rotate; a turn gear 30 having a donut shape where two main gears 31 are connected to an outer surface thereof, provided with six turn gear protruding portions 32 with a circular arc shape having different diameters from a center in an inner surface thereof, and disposed between the slide molds 21 and the turn gear connecting portion 14; a main body cover 40 connected to a front portion of the main body 10 and provided with two deceleration motor connecting portions 41 in a front side thereof; and a deceleration motor 50 coupled to the deceleration motor connecting portions 41 and having a pinion gear 51 which is rotatably interlocked with the main gears 31 at a driving axis.

In addition, six main body holes 15 are provided in the outer surface of the main body 10 and six slide mold springs 60 pulling the slide molds 21 are connected to the main body holes 15. The slide molds 21 is provided with a slide mold protrusion 21*a* having a semi-cylinder shape in a surface making contact with the turn gear 30.

A step 16 is formed in the round bar forming portion 20, and the round bar forming portion 20 with the step 16 and the round bar forming portion 20 without the step 16 are alternately disposed. Also, a distance between a center of the plate hole 11 and the turn gear protruding portion 32 at a side where the step 16 is formed is larger or smaller than a distance between a center of the plate hole 11 and the turn gear protruding portion 32 at a side where the step 16 is not formed.

Furthermore, a distance between a center of the plate hole 11 and the slide mold 21 at a side where the step 16 is formed is larger or smaller than a distance between a center of the plate hole 11 and the slide mold 21 at a side where the step 16 is not formed.

Advantageous Effects

Disclosed is a device for forming a round bar into variable shapes, through which a stainless round bar made of a soft material and inserted into one frame equipped with a feeding device is formed by a forming roll provided in a base frame while being pulled toward a clamp provided in another frame to form the round bar. In case of forming round bars having different sizes, the size of the passage hole between forming rolls can be controlled efficiently and it is unnecessary to dissemble and then re-assemble a mold frame and the forming rolls to adjust the passage hole, or replace with a mold frame having a passage hole meeting a size requirement, in order to adjust the interval of the passage hole, whenever the round bar having different diameters are formed. Thus, it may be able to reduce substantially the time and cost for processing and prohibit a breakage of a component upon replacing the components, thereby remarkably ensuring reliability and durability.

In addition, the incomplete forming which occurs at a corner of the round bars due to slide molds with different heights or steps may be prohibited. Forming rolls spaced apart with different heights and forming rolls having different diameters from a center of a plate hole are alternately arranged, thereby forming polygonal bars with increased size accuracy.

BRIEF DESCRIPTION OF THE DRAWINGS

FIG. 1 is a perspective view illustrating a device for forming a round bar into variable shapes according to the present invention.

FIG. 2 is a perspective view illustrating a main body of a device for forming a round bar into variable shapes according to the present invention.

FIG. 3 is a front elevation view illustrating a device for forming a round bar into variable shapes according to the present invention.

FIG. 4 is a cross-sectional view illustrate a a-a' cross-section of a device for forming a round bar into variable shapes according to the present invention.

FIG. 5 is a cross-sectional view illustrate a b-b' cross-section of a device for forming a round bar into variable shapes according to the present invention.

FIG. 6 is a front elevation view illustrating a turn gear of a device for forming a round bar into variable shapes according to the present invention.

FIG. 7 is a cross-sectional view illustrate a a-a' cross-section of a device for forming a round bar into variable shapes according to a second embodiment of the present invention.

FIG. 8A and FIG. 8B are front elevation views illustrating a slide mold of a device for forming a round bar into variable shapes according to a first embodiment and a second embodiment of the present invention, respectively.

FIG. 9 is a front elevation view illustrating a turn gear of a device for forming a round bar into variable shapes according to a third embodiment of the present invention.

FIG. 10 is a front elevation view illustrating a device for forming a round bar into variable shapes according to a third embodiment of the present invention.

BEST MODE

A device for forming a round bar into variable shapes according to a first embodiment of the present invention is described with reference to FIGS. 1 to 6.

The device for forming a round bar into variable shapes in which a diameter of a passage hole A varies, the device including: a main body 10 provided with a plate portion 12 with a circular shape having a plate hole 11 formed in a center thereof, having six plate protrusions 13 protruding to the plate portion 12 in a radial shape, and a turn gear connecting portion 14 formed at an outer circumference surface of the plate portion 12; a round bar forming portion 20 coupled between the plate protrusions 13 and having six slide molds 21 seated on the plate portion 12 and forming rolls 22 coupled to the respective slide molds 21 to rotate; a turn gear 30 having a donut shape where two main gears 31 are connected to an outer surface thereof, provided with six turn gear protruding portions 32 with a circular arc shape having different diameters from a center in an inner surface thereof, and disposed between the slide molds 21 and the turn gear connecting portion 14; a main body cover 40 connected to a front portion of the main body 10 and provided with two deceleration motor connecting portions 41 in a front side thereof; and a deceleration motor 50 coupled to the deceleration motor connecting portions 41 and having a pinion gear 51 which is rotatably interlocked with the main gears 31 at a driving axis.

In addition, six main body holes 15 are provided in the outer surface of the main body 10 and six slide mold springs 60 pulling the slide molds 21 are connected to the main body holes 15.

The operation of the device for forming a round bar into variable shapes according to a first embodiment is described below.

As shown in FIG. 6, the turn gear protruding portion 32 further includes a first turn gear protruding portion 32*a* and a second turn gear protruding portion 32*b* which have different diameters from a center. While the turn gear 30 rotates due to the pinion gear 51, a diameter of the passage hole A formed by the first turn gear protruding portion 32*a* displacing the slide mold 21 into a center and a diameter of the passage hole A formed by the second turn gear protruding portion 32*b* displacing the slide mold 21 into a center are different from each other, thereby making it easy to change the diameter of the passage hole A between forming rolls by the operation of the deceleration motor 50 when forming round bars of different diameters.

In addition, six main body holes 15 are provided in the outer surface of the main body 10 and six slide mold springs 60 pulling the slide molds 21 are connected to the main body holes 15. Thus, when the diameter of the passage hole A is enlarged due to the turn gear protruding portion 32, the slide mold 21 may be pulled to an opposite side of the passage hole A so as to prevent the diameter of the passage hole A from changing unevenly.

A device for forming a round bar into variable shapes according to a second embodiment of the present invention is described with reference to FIGS. 7 and 8B.

A step 16 is formed in the round bar forming portion 20, and the round bar forming portion 20 with the step 16 and the round bar forming portion 20 without the step 16 are alternately disposed, which can prevent the incomplete forming occurring at a corner of the round bar, resulting from slide modes having different heights. Also, the slide molds 21 is provided with a slide mold protrusion 21*a* having a semi-cylinder shape in a surface making contact with the turn gear 30, which can concentrate the force exerted toward the slide mold 21 from the turn gear protruding portion 32, thereby effectively performing the round bar forming.

A device for forming a round bar into variable shapes according to a third embodiment of the present invention is described with reference to FIGS. 9 and 10.

In the third embodiment aforementioned, the distance between a center of the plate hole 11 and the turn gear protruding portion 32 at a side where the step 16 is formed may become larger or smaller than a distance between a center of the plate hole 11 and the turn gear protruding portion 32 at a side where the step 16 is not formed, thereby resolving the problem of incomplete forming occurring at a corner of polygon due to the step between a forming roll and a neighboring forming roll.

The operation of the device for forming a round bar into variable shapes according to a third embodiment is described below.

A soft stainless round bar having a circular cross-sectional shape is fed to a front side of the device of the present invention by a method of coining or drawing. The three surfaces processed by the round bar forming portion 20 disposed at a side where a distance B' between the turn gear protruding portion 32 and a center of the plate hole 11 is small and the step 16 is formed may be formed to be smaller than the right size. Then, the other three surfaces can be continuously processed to have the right size by the round bar forming portion 20 disposed at a side where a distance B between the turn gear protruding portion 32 and a center of the plate hole 11 is large and the step 16 is not formed.

As such, the three surfaces are formed to become smaller than the right size and then the other three surfaces are formed in the right size, and accordingly, the alteration in the size of the soft round bar resulting from the step 16 can be prevented.

As described above, therefore, the incomplete forming at the corner of the round bar resulting from the turn gear protruding portions 32, in which distances between the forming roll 22 spaced apart due to the step 16 and a center of the plate hole 11 are different from each other, can be prevented. Also, the size alteration of the round bar caused by the softness and the processing sequence can be remarkably decreased.

In addition, a distance between the plate hole 11 and the slide mold 21 at a side where the step 16 is formed may be larger or smaller than a distance between a center of the plate hole 11 and the slide mold 21 at a side where the step 16 is not formed, which has the same effect of providing the turn gear protruding portions 32 having different distances between the forming roll 22 spaced apart by the step 16 and the center of the plate hole 11.

In order to adjust the distance from the turn gear protruding portion 32 to the center of the plate hole 11, it may be possible to adjust either a protrusion length of the turn gear protruding portion 32 or the length of the slide mold 21 toward the plate hole 11 from the turn gear protruding portion 32. In addition, it is evident to apply known prior arts for adjusting the diameter to be processed besides the aforementioned methods.

The embodiments 1 to 3 described the device for forming a round bar to a bar having a hexagonal cross-sectional shape. Using the structure described above, it is evident that one of ordinary skill in the art can easily apply the same for a structure for forming a bar having a polygonal cross-sectional shape, e.g., quadrilateral or octagon.

The present invention is not limited to the preferred embodiments described above, and without departing from the point of the present invention claimed in the appended claims, the one skilled in the art to which the present invention pertains can make various changes or modifications. Such changes or modifications fall within the scope of the appended claims.

What is claimed is:

1. A device for forming a round bar into variable shapes where a diameter of a passage hole (A) varies, the device comprising:

a main body (10) provided with a plate portion (12) with a circular shape having a plate hole (11) formed in a center thereof, having six plate protrusions (13) protruding to the plate portion (12) in a radial shape, and a turn gear connecting portion (14) formed at an outer circumference surface of the plate portion (12);

a round bar forming portion (20) coupled between the six plate protrusions (13) and having six slide molds (21) seated on the plate portion (12) and six forming rolls (22) each coupled to a slide mold (21) to rotate; and a turn gear (30) having a donut shape, provided with six turn gear protruding portions (32) with a curved arc shape having different distances from a center in an inner surface thereof, and disposed between the slide molds (21) and the turn gear connecting portion (14).

2. The device of claim 1, wherein six main body holes (15) are provided in an outer surface of the main body (10) and each of six slide mold springs (60) pulling one of the six slide molds (21) is connected to the main body holes (15).

3. The device of claim 1, wherein each of the slide molds (21) is provided with a slide mold protrusion (21*a*) having a semi-cylinder shape in a surface making contact with the turn gear (30).

4. The device of claim 1, wherein a step (16) is formed in the plate portion (12), and the round bar forming portion (20) with the step (16) and the round bar forming portion (20) without the step (16) are alternately disposed.

5. The device of claim 4, wherein a distance between a center of the plate hole (11) and the turn gear protruding portion (32) at a side where the step (16) is formed is larger or smaller than a distance between a center of the plate hole (11) and the turn gear protruding portion (32) at a side where the step (16) is not formed.

6. The device of claim 4, wherein a distance between a center of the plate hole (11) and the slide mold (21) at a side where the step (16) is formed is larger or smaller than a distance between a center of the plate hole (11) and the slide mold (21) at a side where the step (16) is not formed.

7. The device of claim 1, further comprising;

a main body cover (40) connected to a front portion of the main body (10) and provided with a deceleration motor connecting portion (41) in a front side thereof; and a deceleration motor (50) coupled to the deceleration motor connecting portion (41) and having a pinion gear (51) which is rotatably interlocked with a main gear (31) at a driving axis, wherein the main gear (31) is provided in an outer surface of the turn gear (30).

* * * * *